United States Patent [19]

Kaufmann

[11] 4,016,664

[45] Apr. 12, 1977

[54] POCKET HOLDER FOR INTERCHANGEABLE WORKSHEETS

[75] Inventor: Arthur E. Kaufmann, Summit, N.J.

[73] Assignee: William F. Blake, Inc., Summit, N.J.

[22] Filed: Apr. 22, 1976

[21] Appl. No.: 679,239

[52] U.S. Cl. ..... 40/10 R; 40/159; 150/39; 150/47

[51] Int. Cl.[2] ..... A45C 11/04; G09F 3/20

[58] Field of Search ..... 40/10 R, 10 D, 159, 40/158 R, 124.2, 104.19; 150/39, 34, 47; 206/37

[56] References Cited

UNITED STATES PATENTS

| | | | |
|---|---|---|---|
| 1,581,912 | 4/1926 | Born | 40/159 |
| 2,016,176 | 10/1935 | Rand | 40/104.19 |
| 2,090,856 | 8/1937 | Umansky | 40/10 R X |
| 2,369,597 | 2/1945 | Miller | 150/47 |
| 2,531,606 | 11/1950 | Broughton | 150/39 |
| 3,647,056 | 3/1972 | Jacobson et al. | 150/39 X |

*Primary Examiner*—John F. Pitrelli
*Attorney, Agent, or Firm*—Howard E. Thompson, Jr.

[57] ABSTRACT

A neat and practical holder for interchangeable worksheets is provided in a size to comfortably fit shirt and inner jacket pockets, the device being characterized as having on one flat surface backing and mounting means for supporting a worksheet with substantially the entire surface thereof exposed and usable, the opposed flat surface being of a roughened, fabric gripping texture adapted to counteract accidental displacement from a pocket, and a compartment between said surfaces, and accessible along one longer side of the device of a size to receive additional worksheets. The device is particularly intended to facilitate the following of periodically changing routines such, for example, as a doctor's daily schedule of hospital visits and/or house calls.

8 Claims, 6 Drawing Figures

POCKET HOLDER FOR INTERCHANGEABLE WORKSHEETS

THE INVENTION

This invention relates to a neat and practical holder for interchangeable worksheets in a size to comfortably fit shirt and inner jacket pockets, the device being characterized as having on one flat surface backing and mounting means for supporting a worksheet with substantially the entire surface thereof exposed and usable, the opposed flat surface being of a roughened, fabric gripping texture adapted to counteract accidental displacement from a pocket, and a compartment between said surfaces, and accessible along one longer side of the device of a size to receive additional worksheets. The device is particularly intended to facilitate the following of periodically changing routines such, for example, as a doctor's daily schedule of hospital visits and/or house calls.

The art of pocket wallets and card holders is extremely old and highly developed. In most instances, however, such wallets or card holders take the form of foldably related parts with one or more pockets or support means on at least one of the foldable parts to facilitate insertion and removal of cards or sheet members intended for storage or display. While such a system is appropriate for many purposes, the use of such foldable device generally calls for two-hand manipulation; and observation of data on supported cards or sheets necessarily becomes a deliberate and obvious act.

Situations can arise in which the use of such foldable devices becomes awkward or impractical. A doctor, for example, frequently will be carrying a stethoscope, medication, or other equipment so as not to have two hands free to manipulate the foldable type of device. Yet a doctor with a typical busy schedule can have a special need for quick and easy reference to his daily schedule of appointments.

The improved holder for interchangeable worksheets in accordance with the present invention provides for the display of essential information such as an appointment schedule in a manner to be viewed at a glance when the device is held in one hand and without the need for any manipulation. The device is of a neat, flat contour of a size to readily fit inner jacket pockets or shirt pockets, and the surface opposed to the worksheet supporting surface is so textured as to provide an essentially non-slipping engagement with the supporting pocket. Thus a doctor using the device can move about freely, even bending over a bedridden patient with assurance that the device is not likely to be accidentally displayed from his pocket.

Novel features of the improved holder for interchangeable worksheets in accordance with the present invention will be readily apparent from a consideration of the following description having reference to an accompanying drawing in which a preferred adaptation of the device is illustrated with the various parts thereof identified by suitable reference characters in each of the views and in which.

Figure 1:
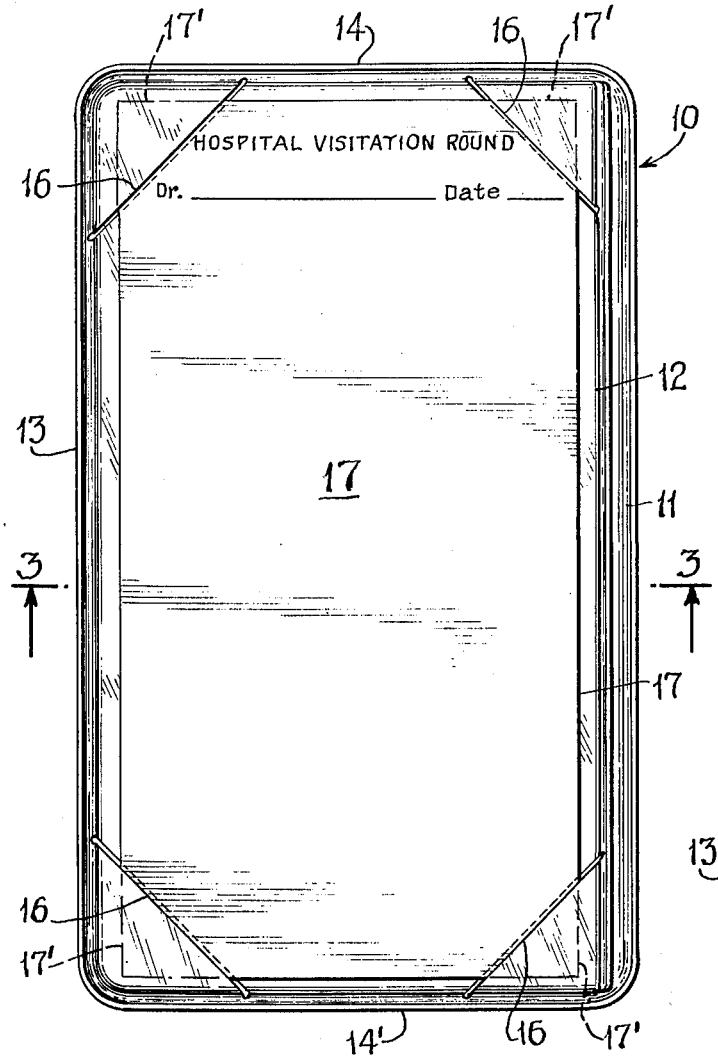
FIG. 1 is a plan view of a holder for interchangeable worksheets in accordance with the present invention with a worksheet affixed thereto.

As shown in the drawing the worksheet holder 10 comprises a body part 11 of generally rectangular contour, and a worksheet mounting part 12 of similar length and slightly narrower width than body part 11, said parts being joined along one long side 13 and along opposed short sides or ends 14,14' to provide therebetween a pocket 15 adopted for the storage of inactive worksheets and other cards and papers. The worksheet mounting part 12 has diagonal slits 16 as the four corner portions thereof as shown for mounting engagement of the corners 17' of an interchangeable worksheet 17.

Figure 2:
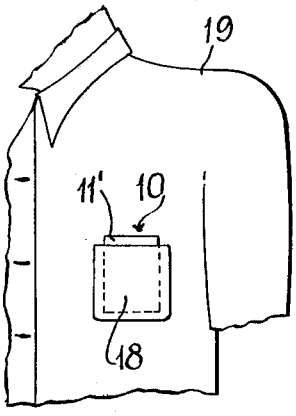
FIG. 2 is a fragmentary view of the shoulder and chest portion of a shirted individual showing the worksheet holder in a shirt pocket.

As shown in FIG. 2 the worksheet holder 10 is preferably of a size to fit the breast pocket 18 of a conventional shirt 19. For this purpose overall dimensions of about 3¾ inches × 6¼ inches are appropriate, and it will be apparent that a device of this size will also comfortably fit conventional inner jacket pockets as well as the breast pockets present on some jackets.

In FIG. 1 the worksheet 17 bears markings "Hospital Visitation Record" with space for entering a doctor's name and date, and a large space in which a schedule of appointments and/or other notes can be listed. This is merely illustrative of the type of uses contemplated for the interchangeable worksheets 17, but it emphasizes the importance of size for easy accommodation of the holder 10 in the accessible pockets above mentioned.

Doctors, when making hospital and home visits, will frequently have to lean over bedridden patients for examination or treatment, and to prevent accidental displacement of the holder 10 from the pocket in such instances, it is preferable that the outer surface 11' of the body part 11 have a suitably roughened contour or texture to provide a non-slipping engagement with the fabric of the supporting pocket. For this purpose the textures of suede leather or the plastics simulating suede leather are appropriate.

The body part 11 is preferably somewhat heavier and more rigid than the mounting portion 12, although the entire assemblage should have some planar flexibility. This can be accomplished by appropriate selection of materials for use in the body part 11 and mounting part 12, or by providing a built-up structure in one or both of these parts.

Figure 3:
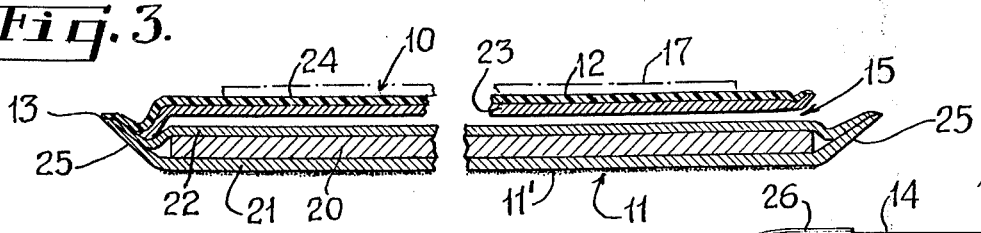
FIG. 3 is an enlarged and contracted sectional view of the holder shown in FIG. 1 taken substantially on the line 3—3 of FIG. 1.

A preferred type of built-up structure has been illustrated in FIG. 3 wherein the body part comprises a filler and stiffening member 20 enveloped by two sheets of material 21,22, the edges of which are secured together peripherally of the member 20. The material of the sheets 21,22 can be leather, fabric, synthetic plastics and the like, and the edges can be secured together by stitching, cementing, or other known means. For ease and economy of assemblage the sheets 21,22 are suitably fashioned from synthetic plastic materials capable of heat sealing, i.e. being bonded to each other by the application of heat and pressure.

The mounting part 12 can comprise a single sheet 23 in which the slits 16 can be formed. It is preferable, however, to fashion the mounting part 12 as a two-part structure in which a sheet 24 of transparent plastic is superimposed on the sheet 23; and in this event the slits 16 will be formed only in the sheet 24.

While the sheets 21,22 and 23 can be of different materials, it is preferable that they be the same, and an elegant effect is created when they all comprise suede leather or plastic sheeting which simulates suede leather. In such event the clear plastic sheet 24 acts as a protector for sheet 23 preventing the soiling or damaging thereof in repeated interchange of worksheets 17.

When all of the sheets 21, 22, 23 and 24 are of heat-sealable material, the assemblage is preferably fashioned to have a contour in cross-section as shown in FIG. 3, i.e. providing a beveled periphery 25 around the outer surface 11' of the body part. This beveled periphery not only permits the assemblage to comfortably fit the hand, as when writing on the worksheet 17, but it also softens the appearance of the edge contour when the device is placed in a shirt pocket, with the surface 11' out, as shown in FIG. 2. The softening of the appearance is also enhanced by rounding of the corners of the device as clearly shown in FIGS. 1, 4, and 5.

Figure 4:
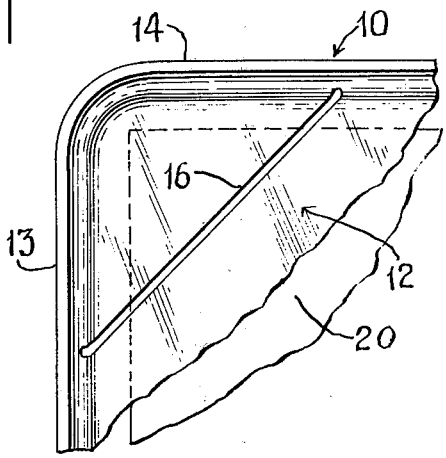
FIG. 4 is an enlarged fragmentary view of a corner portion of the holder shown in FIG. 1.

The enlarged detail shown in FIG. 4 is presented primarily to more clearly illustrate the arrangement and location of the slits 16. They should be actual elongated cut-outs about one thirty-second inch wide to permit easy insertion of the corners 17' of worksheets 17. In the structure shown in FIGS. 3 and 4 ease of inserting the corners 17' is further facilitated by having ends of the slits 16 extend into the downwardly curved portion of the sheet 24 adjacent the edges 13, 14.

Figure 6:
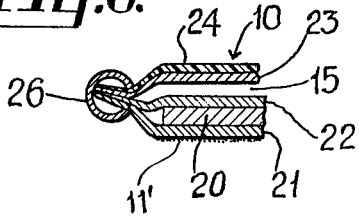
FIG. 6 is an enlarged fragmentary sectional view taken substantially on the line 6—6 of FIG. 5.
Figure 5:
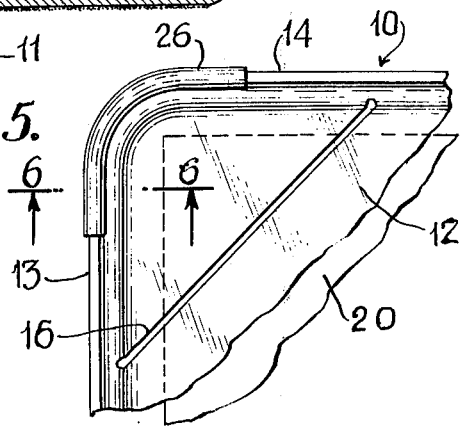
FIG. 5 is a view similar to FIG. 4 showing a modified structure incorporating corner reinforcing means.

FIGS. 5 and 6 show a slightly modified structure in which the corners are ornamented and reinforced by curved metal channel members 26 which are crimped onto the corner edges, and partly embedded in the material thereof as seen in FIG. 6.

Various changes and modifications in the holder for interchangeable worksheets as herein disclosed may occur to those skilled in the art, and to the extend that such changes and modifications are embraced by the appended claims, it is to be understood that they constitute part of the present invention.

I claim:

1. A holder for interchangeable worksheets comprising a generally rectangular backing member which is relatively stiff but has a degree of planar flexibility, a generally rectangular worksheet mounting member having the same length and slightly narrower width than said backing member, said mounting and backing members being secured together along one long side and opposed short sides thereof to provide a pocket therebetween, said holder has dimensions of about 3¾ inches × 6¼ inches thereby adapting the same to freely fit conventional shirt breast pockets as well as inner jacket pockets, the outer surface of said backing member having a roughened, suede-like surface, to thereby prevent accidental displacement of said holder from said shirt or jacket pockets, and said mounting member having diagonal cut-outs adjacent the four corners thereof facilitating insertion of the corners of a worksheet beneath said mounting member and support of the remainder of said worksheet superimposed on said mounting member.

2. A holder for interchangeable worksheets as defined in claim 1 wherein said backing member and mounting member comprise heat-sealable plastic material facilitating the joining along said one long side and opposed short sides by application of heat and pressure.

3. A holder for interchangeable worksheets as defined in claim 1, wherein said backing member is of three-part construction comprising two thin sheets of material, joined at their peripheral edges, with a stiffening member of slightly smaller dimensions disposed therebetween.

4. A holder for interchangeable worksheets as defined in claim 1, wherein said mounting member is of two-part construction comprising an ornamental sheet and a superimposed clear plastic sheet, said sheets being of the same size and joined at their peripheral edges, and said corner cut-out being only in said clear plastic sheet.

5. A holder for interchangeable worksheets as defined in claim 4, wherein the corner cut-outs in said clear plastic sheet are about one thirty-second inch wide facilitating insertion of worksheet corners when superimposing a worksheet on said mounting member.

6. A holder for interchangeable worksheets as defined in claim 1, wherein the outer periphery of said backing member is beveled in the direction of said mounting member thereby providing a comfortable, hand-fitting contour when holding the device for observing or writing on a worksheet.

7. A holder for interchangeable worksheets as defined in claim 1, wherein the generally rectangular assemblage of backing and mounting members is provided with uniformly rounded corners.

8. A holder for interchangeable worksheets as defined in claim 1, wherein the generally rectangular assemblage of backing and mounting members is provided with uniformly rounded corners, and said corners are ornamented and protected by curved metal channel members crimped to the materials of said assemblage at said corners.

* * * * *